US010066901B2

(12) United States Patent
Dahl et al.

(10) Patent No.: US 10,066,901 B2
(45) Date of Patent: Sep. 4, 2018

(54) OUTER GARMENT FOR CARRYING A CONCEALED OBJECT

(71) Applicants: Jason Dahl, Castle Rock, CO (US); Lacey Dahl, Castle Rock, CO (US)

(72) Inventors: Jason Dahl, Castle Rock, CO (US); Lacey Dahl, Castle Rock, CO (US)

( * ) Notice: Subject to any disclaimer, the term of this patent is extended or adjusted under 35 U.S.C. 154(b) by 0 days.

(21) Appl. No.: 14/550,684

(22) Filed: Nov. 21, 2014

(65) Prior Publication Data

US 2015/0144673 A1 May 28, 2015

Related U.S. Application Data

(60) Provisional application No. 61/907,021, filed on Nov. 21, 2013.

(51) Int. Cl.

| | |
|---|---|
| ***F41C 33/00*** | (2006.01) |
| ***F41C 33/02*** | (2006.01) |
| ***F41C 33/04*** | (2006.01) |
| ***A41D 27/20*** | (2006.01) |
| ***A45F 5/02*** | (2006.01) |

(52) U.S. Cl.

CPC ..... *F41C 33/00* (2013.01); *A41D 27/20* (2013.01); *A45F 5/022* (2013.01); *F41C 33/0236* (2013.01); *F41C 33/046* (2013.01); *F41C 33/048* (2013.01); *A45F 2200/0591* (2013.01)

(58) Field of Classification Search

CPC .. F41C 33/00; F41C 33/0218; F41C 33/0209; F41C 33/048; F41C 33/046; F41C 33/0227; F41C 33/0236; Y10S 224/911; A41D 1/04; A41D 13/0012; A41D 27/20; A45F 5/02; A45F 5/022; A45F 2200/0591

USPC ..... 224/587, 260, 192; 2/69, 102, 103

See application file for complete search history.

(56) References Cited

U.S. PATENT DOCUMENTS

| | | | | | |
|---|---|---|---|---|---|
| 139,950 | A | * | 6/1873 | Garaud | A41D 13/0012 2/94 |
| 739,166 | A | * | 9/1903 | Funk | A41D 1/04 2/102 |
| 1,797,359 | A | * | 3/1931 | Meyers | A45C 1/04 2/94 |
| 2,476,665 | A | | 7/1949 | Jones | |
| 2,919,443 | A | | 1/1960 | Kashiyama | |
| 3,720,013 | A | | 3/1973 | McDonald | |
| D234,840 | S | | 4/1975 | Adams | |
| 4,106,121 | A | | 8/1978 | Belson | |
| 4,262,832 | A | | 4/1981 | Perkins | |
| 4,369,526 | A | | 1/1983 | Clutts | |
| 4,453,274 | A | | 6/1984 | Allen | |
| 4,545,079 | A | | 10/1985 | Bakken | |
| 4,796,304 | A | | 1/1989 | Shelby | |
| 4,882,786 | A | | 11/1989 | Gross | |
| 4,903,874 | A | | 2/1990 | Shoemaker | |
| 4,998,654 | A | | 3/1991 | Bruzek et al. | |
| 5,031,244 | A | | 7/1991 | Inagaki | |
| 5,127,565 | A | | 7/1992 | Grant | |

(Continued)

*Primary Examiner* — Nathan J Newhouse
*Assistant Examiner* — Matthew Theis
(74) *Attorney, Agent, or Firm* — Sheridan Ross P.C.

(57) ABSTRACT

Embodiments of the invention relate to garments with at least one pocket for containing and allowing efficient retrieval of a concealed item, such as a handgun or other weapon. In some embodiments, the garments are upper body garments, such as a shirt, jacket, or vest, with at least one pocket for containing and allowing efficient retrieval of a concealed item.

3 Claims, 12 Drawing Sheets

(56) References Cited

U.S. PATENT DOCUMENTS 5,129,560 A * 7/1992 Herman ..... A45F 3/00 224/153
5,265,782 A 11/1993 McNamara
5,689,829 A 11/1997 Rose
5,692,237 A * 12/1997 Bennett ..... F41C 33/00 2/250
5,832,536 A 11/1998 Kramer
5,845,336 A 12/1998 Golde
5,894,976 A 4/1999 Harper
D414,014 S 9/1999 Blankenship, Jr.
6,131,198 A 10/2000 Westrick
6,324,697 B1 12/2001 Shofner
6,695,186 B2 2/2004 Madarang
6,760,922 B1 7/2004 Morales
6,874,163 B2 * 4/2005 Marshall ..... A41D 13/0012 2/102
6,986,164 B1 1/2006 Morales et al.
7,058,987 B2 6/2006 Salazar
7,631,368 B1 12/2009 Samson
7,681,255 B2 3/2010 Morales et al.
7,886,368 B2 * 2/2011 Hood ..... A41D 1/002 2/102
7,926,448 B2 4/2011 Fox
7,987,520 B2 8/2011 Henriquez
7,988,023 B1 8/2011 Nykoluk
8,074,850 B2 12/2011 Soderquist et al.
8,302,827 B1 * 11/2012 Cole ..... F41C 9/02 224/243
8,307,465 B2 11/2012 French et al.
8,312,568 B2 11/2012 Marois et al.
8,328,058 B2 12/2012 Wilson
8,332,967 B2 12/2012 Echikson
8,371,487 B1 2/2013 Plappert
8,407,816 B2 4/2013 Rhoades, II
8,448,264 B2 5/2013 Ellsworth
8,484,765 B2 7/2013 French
8,505,118 B2 8/2013 Bang
8,522,367 B2 9/2013 French et al.
2003/0205595 A1 * 11/2003 Young ..... A45F 5/02 224/230
2005/0022289 A1 2/2005 Platt
2005/0223466 A1 10/2005 Jennings et al.
2007/0250980 A1 11/2007 Pellerin
2009/0218379 A1 9/2009 Harris et al.
2011/0185471 A1 * 8/2011 Buczkowski ..... A41D 3/00 2/84
2011/0214212 A1 9/2011 Marx et al.
2011/0220698 A1 9/2011 Tuggle
2011/0277212 A1 * 11/2011 Jones ..... A41D 13/0005 2/102
2012/0085802 A1 4/2012 Ferrante
2012/0280008 A1 11/2012 Rossetti et al.
2013/0015225 A1 1/2013 Hogue
2013/0098956 A1 4/2013 Pylypiak
2013/0175309 A1 7/2013 King

* cited by examiner

OUTER GARMENT FOR CARRYING A CONCEALED OBJECT

RELATED APPLICATION

This application claims the benefit of U.S. Provisional Patent Application Ser. No. 61/907,021, filed Nov. 21, 2013, entitled "Outer Garment for Carrying a Concealed Object," which is hereby incorporated by reference in its entirety.

FIELD OF THE INVENTION

The invention relates to garments, in particular garments with at least one pocket for containing and allowing efficient retrieval of a concealed item, especially a weapon such as a handgun. More specifically, the invention relates to garments for the upper body, such as a shirt, jacket, or vest, with at least one pocket for containing and allowing efficient retrieval of a concealed item.

BACKGROUND OF THE INVENTION

Law-enforcement personnel are usually authorized to carry protection devices (e.g., handguns, stun guns, pepper sprays, etc.) or other objects (e.g., pocket tool, handcuffs, dagger, passport or other identification, wallet, valuables, etc.) However, when working undercover or on duty in plain clothes, law-enforcement personnel can have a problem with telegraphing, which is sometimes referred to as "profiling" or "mapping." The same problem applies to civilians licensed to carry concealed weapons. As used broadly herein, "telegraphing" is the tendency for a concealed object (e.g., a handgun) to show through the concealing garment, rendering the concealed object readily detectable by others. Known carrying devices worn by law-enforcement personnel and licensed-to-carry civilians do not sufficiently minimize telegraphing. Furthermore, when an individual is wearing only one or two layers of clothing, such as when the wearer is dressed appropriately for warm weather or for working indoors in a temperature-controlled environment, the presence of the carrying device becomes even more evident. In many instances, the carrying device itself, for example a holster, telegraphs the potential presence of the concealed object that it is carrying. Although many holsters and harnesses strive for ready accessibility of the weapon that they carry, the unfortunately often do not address the problem of "profiling." Instead traditional holsters and harnesses, concealed or visible, are often bulky, uncomfortable to wear, expensive to produce and difficult to conceal. In addition, many holsters are limited in how and where they may be positioned relative to a user's often very specific preferences. Although some holster systems can be utilized in one or even two modes of carry, the inventor is not aware of any device that provides the flexibility to easily customize the position of a holster and conceal its weapon within an upper outer garment pocket, while also allowing for quick access to the weapon from the pocket.

Finally, it is well known that guns are often carried strapped to the legs of officers as well as under the arms of officers. Such devices used to holster these weapons also suffer from inadequacies, including the fact that the holster shifts when the person is trying to reach the weapon, the straps which support the weapon are uncomfortable, and further because of the fact that the holsters are bulky, a close observer can readily detect that the person is wearing a weapon.

Therefore, it would be greatly advantageous to provide the best of both an improved garment for concealing a weapon, designed for either right- or left-handed (or ambidextrous) users, capable of full concealment of the weapon, and which also permits easy accessibility and comfort of wearing of the weapon over a prolonged period of time.

Accordingly, there is a long-felt need for an upper garment system that can carry, in a concealed and readily accessible state, a weapon, handgun, or other object. Additionally, there is a need for a garment system that is readily and easily adjusted to a wearer's weapon, preferred orientation of the weapon in the garment, and preferred method of accessing or drawing the weapon; e.g., from the right or left pocket, from the right, left, top, or bottom side of a pocket, and relative orientation of the weapon itself within the pocket.

SUMMARY OF THE INVENTION

Accordingly, it is an aspect of the present invention to provide an upper outer garment which provides safe and secure support for a weapon, carries the weapon concealed from view, is comfortable for the person wearing it, and comprises a fully adjustable concealment system, integrated into the garment itself, such that the user can easily modify the concealment system according to his/her weapon and style of access, draw, and use.

It is another aspect of the present invention to provide an outer garment for concealing a weapon with an improved holster system, which does not compromise between accessibility and full-concealment, permitting instant accessibility to facilitate a quick-draw.

Still another aspect of the present invention is to provide an improved fully-concealed quick-draw outer garment/weapon system that can supports a weapon both comfortably and securely over a prolonged period of time.

It is still another aspect of the present invention to provide an improved outer garment for fully-concealing a weapon and its support system (e.g, a holster) such that the garment lends itself to a variety of economical manufacturing processes using a variety of alternative economical materials.

An aspect of the present invention is a garment for concealing at least one object, comprising at least one pocket, wherein each pocket comprises a means for accessing an internal volume of the pocket, at least one means for receiving the at least one object when placed in the pocket, a means for attaching the at least one means for receiving to at least one inside surface of the pocket, and an object concealment means integrated into at least one outer surface of each pocket. The garment also comprises at least one means for supporting a weight associated with the at least one object, wherein the means for supporting comprises a first end, a second end, and a length spanning between the first end and the second end, wherein the first end is interconnected to at least one of the at least one means for receiving and the means for attaching, and the second end is interconnected to a weight supporting member.

A further aspect of the present invention is a garment for concealing at least two objects, wherein the garment comprises a left front panel and a right front panel, wherein the left and right panels comprise top and bottom ends, and are separated or connected by a vertically oriented connecting means, and the garment further comprises a collar interconnected to the top ends of the left and right front panels. Further, each front panel comprises a pocket, wherein each pocket comprises a means for accessing an internal volume of the pocket, at least one means for receiving the at least one object when placed in each pocket, a means for attaching the at least one means for receiving to at least one inside surface of each pocket, and an object concealment means integrated into at least one outer surface of each pocket. Further, the pocket of the right panel comprises a first means for supporting a weight, further comprising a first end and a second end with a length spanning therebetween, and the pocket of the left panel comprises a second means for supporting a weight, also comprising a first end and a second end with a length spanning therebetween. Further, the second end of the first means for supporting a weight and the second end of the second means for supporting a weight both attach to a weight supporting member anchored on a posterior side of the garment in the collar. Finally, the first end of the first means for supporting a weight attaches to at least one of the means for receiving and the means for attaching of the right pocket, and the first end of the second means for supporting a weight attaches to at least one of the means for receiving and the means for attaching of the left pocket.

A further aspect of the present invention is a garment for concealing at least one handgun, comprising at least one pocket, wherein each pocket comprises a means for accessing an internal volume of the pocket, at least one holster for receiving the at least one handgun when placed in the pocket, a means for attaching the at least one holster to at least one inside surface of the pocket, and a handgun concealment means integrated into at least one outer surface of the pocket. Further, the garment comprises at least one harness for supporting a weight associated with the at least handgun, wherein the harness comprises a first end, a second end, and a strap spanning between the first end and the second end, wherein the first end is interconnected to at least one of the at least one holster and the means for attaching, and the second end is interconnected to a weight supporting member.

In a preferred embodiment of the present invention, the concealed object comprises a weapon, namely a handgun. As the distinct outline of a handgun within a person's pocket would normally cause undue concern to observers, one aspect of the present invention relates to the ability to place such a handgun in a garment, which can be an upper torso garment, such that the outline of the weapon is not perceived by an ordinary observer viewing the person with such concealed weapon. In order to accomplish this task, in one embodiment of the present invention a specific cavity is provided in an enclosed pocket whereby suitable padding is provided that not only supports the stowed weapon, but also provides cushioning such that the outer fabric of the upper garment (e.g., a jacket) has fabric that is not placed under stress in a manner that would reveal that a heavy object, like a weapon, is residing within such garment. Thus, in one embodiment, a pocket has a cavity with three distinct over arching padding characteristics, with a first portion above the weapon being of a different thickness and consistency and/or density than a second portion (below the weapon when stored in the pocket), with the lower portion padding being of a more dense material that is able to better support the downward gravitational weight of the weapon when a person is wearing a jacket and is in a standing position. The padding on the top surface of the weapon and underneath the outer fabric of the upper garment of a person, is substantially thinner than the padding on the above-referenced first and second portions. In this manner, the selective predetermined padding characteristics of the first and second portions is selected so that the ultimate outward appearance of the jacket fails to reveal that a weapon has been placed in the interior pocket of such garment.

In still other embodiments of the invention, structural semi-rigid straps are provided and can have a bowed characteristic that extends from an attachment point on the upper portion of a pocket (near or towards the wearer's neck region and a lower portion, near the wearer's waist) such that the bowed stays or longitudinally extending members facilitate the open, cave-like cavity within which a firearm can be located and carried. The semi-rigid bowed stays are designed and placed within the interior of the pocket and beneath at least a covering exterior garment material, such that a weapon stowed within such cavity does not present an outline of the weapon when a wearer of such garment has the weapon stowed therein and is standing in an upright position.

In one embodiment, so-called "memory foam" is employed as the padding material for one of at least the above-referenced first portion, second portion, and overcovering padding for the weapon. Thus, in one embodiment, a weapon is placed into a predetermined pocket substantially defined by the outer configuration of the weapon to be placed therein, with at least a supporting memory foam component supporting the weapon on a lower-most region when a person is in an upright position and the weapon is stowed in the interior pocket, such that the memory foam supports the weapon from falling to the bottom of the pocket and further the memory foam has a perpendicular dimension that extends to project the outermost layer of the garment outward and beyond an edge of the weapon residing near the interior side of the outer fabric of the garment. In such a manner, the memory foam acts to not only support the weapon, but also to conceal the outline of the weapon when the weapon is placed inside the interior pocket of the garment as the individual is standing upright with the weapon stowed in such pocket. Additional embodiments include various supporting means, such as straps, hook and loop material (e.g., Velcro™), or reversibly detachable lanyards, such that a weapon can be secured while also being easily removed from the pocket without unnecessary obstructions from such removal due to gravity defying support structures within the pocket.

In one embodiment of the present invention, a garment for concealing an object is provided comprising: a left front panel comprising a top end and a bottom end, wherein the left front panel is selectively removable and attachable to the garment via at least one of hook and loop material, a zipper, one or more buttons, and one or more clasps; a right front panel comprising a top end and a bottom end, wherein the right front panel is selectively removable and attachable to the garment via at least one of hook and loop material, a zipper, one or more buttons, and one or more clasps; and a pocket in at least one of the left front panel and the right front panel, wherein the pocket comprises: an outer surface; an inner surface; an internal volume defined by the inner surface; an opening providing access to the internal volume; a holder in the internal volume, wherein the holder receives and restrains the object; a securing mechanism releasably interconnected to the holder and a first portion of the inner surface; and an insulation material positioned between the outer surface and the inner surface.

In further embodiments, the garment further comprises a collar interconnected to the top end of the left front panel and the top end of the right front panel. In some embodiments, the securing mechanism can be detached from the first portion of the inner surface and interconnected to a second portion of the inner surface. In one embodiment, the garment comprises a support strap for supporting the object, the support strap comprising: a first end; a second end; and a middle portion between the first end and the second end, wherein the first end is interconnected to the holder and the securing mechanism, wherein the second end is interconnected to a supporting member. Additionally, the supporting member is at least one of a hook, a loop, a clip, a button, a snap, a clasp, and fabric interconnected to an inner portion of the garment positioned above the pocket. For example, the supporting member is interconnected to an inner side of a collar. In various embodiments, the holder is a holster with a trigger guard. Further, the opening can have a closure mechanism to selectively prevent access to the internal volume. For example, the closure mechanism is at least one of a zipper, one or more buttons, one or more magnetic buttons, one or more snaps, hook and loop material, and one or more hooks.

In one embodiment of the present invention, a garment for concealing an object is provided comprising: a garment for concealing an object, comprising: a left front panel comprising a top end and a bottom end, wherein the left front panel is selectively removable and attachable to the garment via at least one of hook and loop material, a zipper, one or more buttons, and one or more clasps; a right front panel comprising a top end and a bottom end, wherein the right front panel is selectively removable and attachable to the garment via at least one of hook and loop material, a zipper, one or more buttons, and one or more clasps; a pocket in at least one of the left front panel and the right front panel, wherein the pocket comprises: an outer surface; an inner surface; an internal volume defined by the inner surface; an opening providing access to the internal volume; a holder in the internal volume, wherein the holder receives and restrains the object; and a securing mechanism releasably interconnected to the holder and a first portion of the inner surface; and a support strap for supporting the object, the support strap having a first end interconnected to the pocket, a middle portion extending from the first end and over a shoulder region of the garment to a rear portion of the garment, and a second end interconnected to the rear portion of the garment. In a further embodiment the garment further comprises a substantially horizontal strap interconnected to the second end of the support strap. In additional embodiments, the pocket is positioned in the left front panel, wherein the garment further comprises a second pocket in the right front panel, the pocket including: an outer surface; an inner surface; an internal volume defined by the inner surface; an opening providing access to the internal volume; a holder in the internal volume; and a securing mechanism releasably interconnected to the holder and a first portion of the inner surface.

In one embodiment, a garment for concealing a handgun is provided comprising: a collar; a pocket comprising: an outer surface; an inner surface; an internal volume defined by the inner surface; an opening providing access to the internal volume; a holster positioned within the internal volume and having a trigger-guard; a plurality of hook structures interconnected to the holster; a plurality of loop structures interconnected to the inner surface of the pocket and oriented in a direction facing the plurality of hook structures; and a substantially rigid sheet positioned between the outer surface of the pocket and the inner surface of the pocket to prevent an outline of the handgun from being perceived by an observer; and a harness for supporting a weight of the handgun, wherein the harness comprises a first end, a second end, and a middle portion between the first end and the second end, wherein the first end is interconnected to at least one of the holster, the plurality of hook structures, and the plurality of loop structures, and wherein the second end of the harness is interconnected to a supporting member positioned on an inner surface of the collar.

In additional embodiments, the plurality of hook structures is adjustably and reversibly positioned and the plurality of loop structures is adjustably and reversibly positioned such that holster can be positioned in multiple positions within the internal volume. In some embodiments, the opening has a closure mechanism to selectively prevent access to the internal volume. For example, the closure mechanism is at least one of a zipper, one or more buttons, one or more magnetic buttons, one or more snaps, hook and loop material, and one or more hooks. In one embodiment, the supporting member is at least one of a hook, a loop, a clip, a button, a snap, a clasp, and fabric interconnected to an inner portion of the garment positioned above the pocket.

In one embodiment, a garment for concealing a handgun is provided comprising: a garment for concealing a handgun, comprising: an outer surface; an inner surface; a vest interconnected to the inner surface, the vest comprising: a rear portion; a front portion with a pocket, the pocket including: an outer surface; an inner surface; an internal volume defined by the inner surface; an opening providing access to the internal volume; and a holster positioned within the internal volume and having a trigger-guard; and a plurality of support straps for supporting a weight of the handgun, wherein a first support strap in the plurality of support straps is interconnected on one end to a center portion of the vest and interconnected on a second end to an armpit portion of the vest and a middle portion of the first support strap is interconnected to an upper portion of the pocket, wherein a second support strap in the plurality of support straps is interconnected on one end to the middle portion of the first support strap and interconnected on a second end to a rear portion of the vest and a middle portion of the second support strap extends over a shoulder portion of the vest. In further embodiments, the vest is comprised of a mesh-like material that stretches in a horizontal direction more than it stretches in a vertical direction.

In one embodiment, a method of manufacturing a garment for concealing an object is provided comprising: providing a garment comprising: a back portion; a first sleeve portion; a second sleeve portion; a left front panel with a top end and a bottom end; a right front panel with a top end and a bottom end; providing a pocket in at least one of the left front panel and the right front panel, wherein the pocket comprises: an outer surface; an inner surface; an internal volume defined by the inner surface; an opening providing access to the internal volume; a holder in the internal volume, wherein the holder receives and restrains the object; a securing mechanism releasably interconnected to the holder and a first portion of the inner surface; and an insulation material positioned between the outer surface and the inner surface; and a support strap for supporting a weight of the object, wherein the support strap comprises a first end, a second end, and a middle portion between the first end and the second end, wherein the first end is interconnected to the at least one holder and to the securing mechanism, and the second end is interconnected to a supporting member.

In additional embodiments, the supporting member is at least one of a hook, a loop, a clip, a button, a snap, a clasp, and fabric interconnected to an inner portion of the garment positioned above the pocket. Further, the opening has a closure mechanism to selectively prevent access to the internal volume. For example, the closure mechanism is at least one of a zipper, one or more buttons, one or more magnetic buttons, one or more snaps, hook and loop material, and one or more hooks. In various embodiments, the pocket further comprises a substantially rigid sheet positioned between the outer surface of the pocket and the inner surface of the pocket.

In one embodiment, a method of manufacturing a garment for concealing an object is provided comprising: providing a garment comprising: a back portion; a first sleeve portion; a second sleeve portion; a left front panel with a top end and a bottom end; a right front panel with a top end and a bottom end; providing a pocket in at least one of the left front panel and the right front panel, wherein the pocket comprises: an outer surface; an inner surface; an internal volume defined by the inner surface; an opening providing access to the internal volume; a holder in the internal volume, wherein the holder receives and restrains the object; and a securing mechanism releasably interconnected to the holder and a first portion of the inner surface; and a support strap for supporting a weight of the object, wherein the support strap comprises a first end, a second end, and a middle portion between the first end and the second end, wherein the first end is interconnected to the pocket, and the second end is interconnected to at least one of a supporting member, a rear portion of the garment, and a second support strap.

One will appreciate that this Summary of the Invention is not intended to be all encompassing and that the scope of the invention nor its various embodiments, let alone the most important ones, are necessarily encompassed by the above description. One of skill in the art will appreciate that the entire disclosure, as well as the incorporated references, pictures, etc. will provide a basis for the scope of the present invention as it may be claimed now and in future applications. The preceding is a simplified summary to provide an initial understanding of the aspects, embodiments and configurations disclosed herein. This summary is neither an extensive nor exhaustive overview of the aspects, embodiments, or configurations. It is intended neither to identify key or critical elements, nor to delineate the scope of the aspects, embodiments, or configurations but to present selected concepts in a simplified form as an introduction to the more detailed description presented below. As will be appreciated, other aspects, embodiments, and configurations are possible utilizing, alone or in combination, one or more of the features set forth above or described in detail below.

BRIEF DESCRIPTION OF DRAWINGS

The accompanying drawings are incorporated into and form a part of the specification to illustrate examples of how the aspects, embodiments, or configurations can be made and used and are not to be construed as limiting the aspects, embodiments, or configurations to only the illustrated and described examples. Further features and advantages will become apparent from the following, more detailed, description of the various aspects, embodiments, or configurations.

Figure 1:
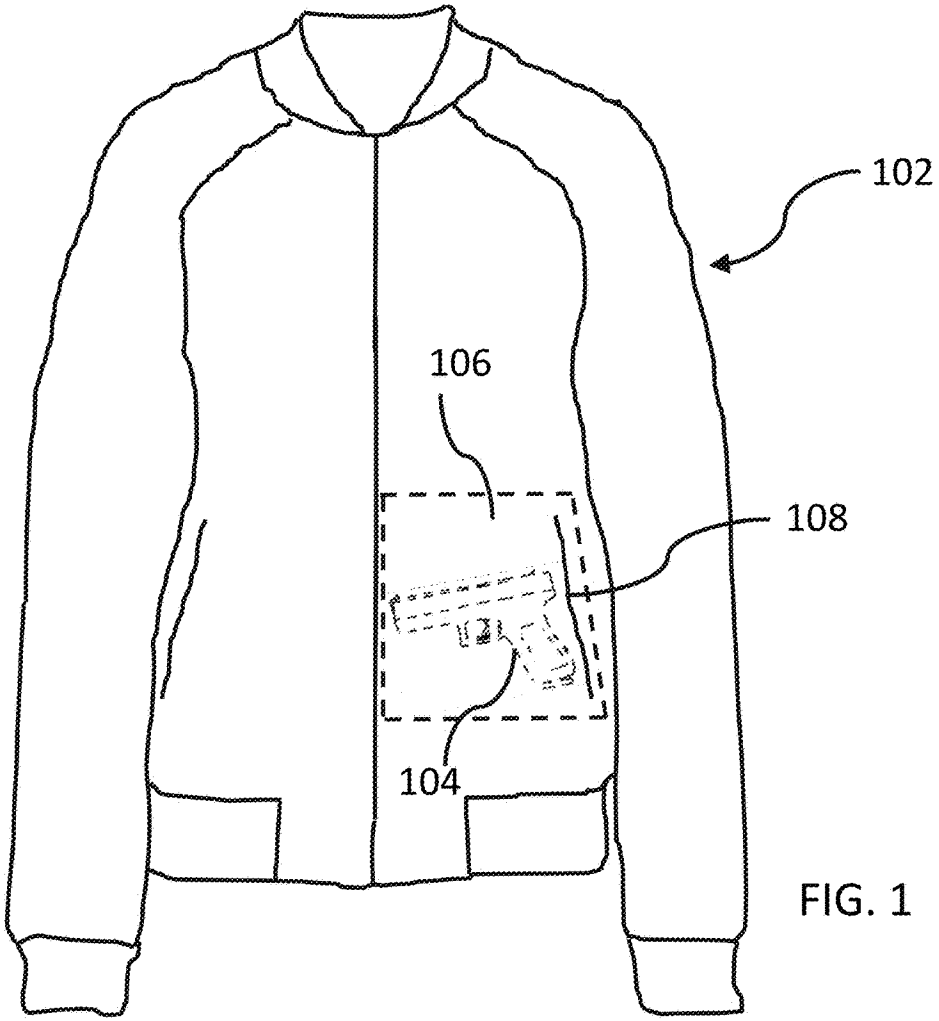
FIG. 1 illustrates an embodiment of a long-sleeve outer garment comprising a pocket concealing an object.

To assist in the understanding of the embodiments of the present invention the following list of components and associated numbering found in the drawings is provided herein:

| No. | Component |
|---|---|
| 102 | Garment |
| 104 | Concealed item |
| 106 | Pocket |
| 108 | Means for access |
| 110 | Receiving means |
| 112 | Attachment means |
| 114 | Object concealment means |
| 410 | Holster |
| 420 | Trigger guard |
| 430 | Tab |
| 440 | Connectors in use |
| 450 | Connectors not in use |
| 510 | Attachment panel |
| 520 | Support means |
| 610 | Weight support member |

DETAILED DESCRIPTION OF EMBODIMENTS

The following detailed description illustrates the invention by way of example and not by way of limitation. This description will clearly enable one skilled in the art to make and use the invention.

The present invention relates to an outer garment comprising at least one pocket with unique features that enable the concealment and simultaneous carry of at least one weapon or other object, such that the weapon or weapons can be safely carried and quickly drawn from the pockets, without the need for separate, additional underlying garments or components; e.g., vests, under wear, shoulder holsters, etc. The present invention instead provides a complete concealed weapon carrying system contained within a single garment.

To reduce the need to provide extensive disclosure in this application, but to provide adequate written description of the various devices and methods encompassed by the numerous embodiments of the present invention, various patents are incorporated herein in their entireties by this reference. The following U.S. issued patents are incorporated herein by reference in their entirety. It will therefore be appreciated by one of skill in the art that various structural elements can be combined with the present structure of the present invention to achieve various desired purposes.

U.S. Design Pat. No. 234,840 discloses a vest-like garment for carrying a weapon in a holster, handcuffs and extra cartridges. U.S. Pat. No. 4,262,832 discloses a vest-type garment including a pocket for carrying a concealed weapon, wherein the holster is detachable from the garment. U.S. Pat. No. 4,369,526 discloses a utility vest, which has a separate utility apron spreading the weight of the tools over a larger area of the body. U.S. Pat. No. 4,453,274 discloses a two-part athletic vest such that the color exposed may be quickly and easily changed without removal of the vest. U.S. Pat. No. 4,796,304 discloses a ventilated hunting vest which has a mesh material secured over the exterior portion thereof forming large ventilated pockets for containing food, game or the like. U.S. Pat. No. 4,882,786 discloses a specialized vest including a pocket for supporting the arm of the wearer when he is carrying a rifle or a shotgun. U.S. Pat. No. 4,903,874 discloses a shoulder holster including interconnecting straps. U.S. Pat. No. 4,998,654 discloses an article carrier vest with means to attach carrier bags. U.S. Pat. No. 5,031,244 discloses a garment made of a mesh material and including a folded portion at the bottom on the vest to hold one or more heating devices. U.S. Pat. No. 5,127,565 discloses an ammunition-dispensing garment. U.S. Pat. No. 5,265,782 discloses a military medical vest wherein the vest accommodates the supplies and paraphernalia typically used by a military medic. U.S. Pat. No. 3,720,013 discloses a pistol concealing bag-like holster having the outward appearance of a purse or tobacco pouch. Hidden vest panels or pockets have been used for concealing a gun. See, for example, Bennett U.S. Pat. No. 5,692,237. Other patents incorporated by reference in their entirety for enabling purposes include U.S. Pat. Nos. 6,324,697; 6,131,198; 5,894,976; 5,845,336; 5,692,237; 5,689,829; 4,998,654; 4,882,786; 4,545,079; 4,262,832; 4,106,121; 2,919,443; 2,476,665; and D414,014.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein, "at least one", "one or more", and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

An aspect of the present invention is a garment for concealing at least one object, comprising at least one pocket, wherein each pocket comprises a means for accessing an internal volume of the pocket, at least one means for receiving the at least one object when placed in the pocket, a means for attaching the at least one means for receiving to at least one inside surface of the pocket, and an object concealment means integrated into at least one outer surface of each pocket. The garment also comprises at least one means for supporting a weight associated with the at least one object, wherein the means for supporting comprises a first end, a second end, and a length spanning between the first end and the second end, wherein the first end is interconnected to at least one of the at least one means for receiving and the means for attaching, and the second end is interconnected to a weight supporting member.

In some embodiments of the present invention a garment may comprise a jacket, a coat, a parka, a shirt, a vest, a smock, a blouse, a dress, a pullover, a turtleneck, a sweater, a jersey, and a tunic. In some embodiments of the present invention, the garment may comprise at least one pocket, cavity, or pouch that is integrally constructed and built into the garment. A pocket may comprise a front, outward-facing panel and an inner panel. The panels of a pocket may be separate and independent panels, or alternatively, may be portions of larger panels used to construct larger sections of the garment. The panels of a pocket may be sewn or stitched together, or fastened together by any other suitable means known to one of ordinary skill in the art of clothing manufacture. A panel may comprise multiple panels sewn, stitched, or otherwise connected, such as the panels of a quilt.

In some embodiments of the present invention the garment may comprise at least one pocket, wherein the pocket comprises a front panel interconnected to an inner panel. The front panel may be positioned substantially parallel to the inner panel and on top of the inner panel. In some embodiments, the front panel may comprise at least two, three, or four edges that are interconnected to the inner panel. In some embodiments, the front panel may comprise at least four edges that are interconnected to the inner panel. In still further embodiments of the present invention, the garment may comprise at least one pocket comprising a front panel interconnected to an inner panel, wherein the front panel comprises at least two edges, wherein at least one of the edges comprises a means for accessing the internal volume of the pocket. Such a pocket is referred to herein as an "external pocket."

Alternatively, in some further embodiments of the present invention, the garment may comprise at least one pocket referred to herein as an "internal pocket." An internal pocket may comprise a large front panel for constructing more than just the pocket, and a smaller inner panel substantially parallel to the front panel, and underneath the front panel. The inner panel may be interconnected to the front panel by any suitable means known to one of ordinary skill in the art of clothing manufacture; e.g., sewn, stitched, glued, heat-welded, etc. In some embodiments, the front panel may further comprise at least one means for accessing the pocket formed by the attachment of the outer panel to the inner panel. In some embodiments of the present invention, the means for accessing the internal volume of the pocket may by a hole formed through the front panel.

The panels used to construct some of the embodiments of the garments of the present invention, may be made from any suitable material or fabric known to one of ordinary skill in the art of clothing manufacture. Examples include, but are not limited to, at least one of polyester, linen, nylon, cotton, acrylic, acetate, silk, wool, Rayon, Spandex, acrylic, leather and combinations thereof.

In still further embodiments, the means for accessing the internal volume of a pocket may further comprise at least one of a zipper, a button, a magnetic button, a clasp, a hook, a snap, hook and loop material, and any other suitable means for opening and closing the pocket, and combinations thereof. In some further embodiments of the present invention the means for accessing the internal volume of a pocket may comprise at least one of a zipper, a button, or other closure mechanism, wherein the closure mechanism can be locked and unlocked for safety reasons. For some examples of "external pockets," the means for accessing the internal volume of a pocket may be an edge of the front panel that is not stitched, sewn, or otherwise connected to the rear panel. In still further embodiments of the present invention, the garment for concealing an object comprises at least one pocket with at least one means for accessing the internal volume that does not comprise a zipper, a conventional button, a magnetic button, or any other suitable means for restricting access to the handgun. In other words, the means for accessing the internal volume of a pocket may simply be an opening with no means for restricting access to the contents of the pocket.

In still further embodiments of the present invention, a pocket may comprise more than one means for accessing the internal volume of the pocket. For example, a pocket may comprise a first means for accessing the internal volume of the pocket from a right vertical side of the pocket; e.g., using the right hand. However, the same pocket may comprise a second means for accessing the internal volume of the pocket from a left vertical side of the pocket; e.g., using the left hand. In addition, the same pocket may further comprise a third and/or fourth means for accessing the internal volume of the pocket from both the top and/or the bottom horizontal sides of a pocket. This type of pocket construction, with more than one means of access to the internal pocket volume, is envisioned for both internal and external constructed pockets. In other words, a pocket may comprise more than one opening for accessing the pocket's internal volume. Further, each opening may or may not have a means for restricting access to the contents; e.g., a zipper or buttons. This is one example of the unique design features of the present invention that allows a user to customize storage and access to their concealed object, handgun or otherwise from any desired entry direction into the pocket such as from the left, right, top and/or bottom.

In some embodiments of the present invention, the internal volume of the at least one pocket of the garment for concealing an object is large enough to store in a concealed state at least one of a handgun, a revolver, a pistol, a knife, mace, pepper spray, handcuffs, a baton, a flashlight, ammunition, a radio and any other similarly sized object. In some embodiments of the present invention, the internal volume of the at least one pocket is approximately 100 ml, about 200 ml, about 300 ml, about 400 ml, about 500 ml, about 600 ml, about 700 ml, about 800 ml, about 900 ml, or about 1000 ml. In some embodiments, the internal volume of the at least one pocket ranges from about 100 ml to about 1000 ml. In some further embodiments of the present invention, the internal volume of the at least one pocket is about 1 liter, about 2 liters, about 3 liters, about 4 liters, or about 5 liters. In some further embodiments of the present invention, the internal volume of the at least one pocket ranges from about 1 liter to about 5 liters.

In some embodiments of the present invention, the garment for concealing an object may comprise at least one pocket comprising a three-dimensional shape selected from the group consisting of a cylinder, a rectangular prism, a triangular prism, a triangular pyramid, a cube, a cone, a sphere, and any other suitable three-dimensional shape.

In some embodiments of the present invention, the object concealed in the garment may comprise at least one of a weapon, a handgun, a revolver, a pistol, a knife, mace, pepper spray, handcuffs, a baton, a flashlight, ammunition, a radio and any other object suitably sized to fit within the internal volume of the pocket.

In some embodiments of the present invention, the means for receiving may comprise at least one of a holster, a holder, a sheath, a socket, a quiver, a scabbard, a bin, a box, a capsule, a case, a container, a cartridge holder, and any other device suitable for receiving and holding an object to be concealed in a fashion that allows quick and easy insertion and removal of the object to be concealed, both to and from the means for receiving. In some embodiments of the present invention, the means for receiving may comprise a three-dimensional structure comprising at least one outside structure which forms an internal volume for receiving and restraining the object to be stored; e.g., a handgun. Examples of holsters that may be included in the present invention include, but are not limited to, any standard holster design adapted to fit into a pocket such as waistband holsters, belt holsters, shoulder holsters, sling holsters, belly-band holsters, pocket holsters, thigh holsters, ankle holsters, chest holsters, strut holsters, and any other holster design known to one of ordinary skill in the art. One of ordinary skill in the art will recognize that modifications may be necessary to adapt any of the above holsters to integrate the holster into the pocket or pockets of the present invention. For example, a belt holster may require that the belt be incorporated into the fabric of the garment, around a waste-section of the garment. Alternatively, a shoulder holster may be incorporated into some embodiments of the present invention, wherein the straps of the shoulder holster are built into and integrated into portions and or panels of the garment, to create a single garment system for concealing an object.

In some embodiments of the present invention, a means for receiving an object to be concealed, e.g., a holster, may further comprise a trigger guard for safety purposes. In some embodiments of the present invention, a means for receiving an object to be concealed may be constructed from at least one of a leather, a plastic, a metal, a fabric, any other suitable material, and combinations thereof.

In some embodiments of the present invention, the means for attaching the at least one means for receiving to at least one inside surface of a pocket may comprise a first attachment means that may be physically interconnected to at least one inner surface of the pocket, and a second attachment means that may be physically interconnected to the means for receiving an object to be concealed, wherein the first and second attachment means are adjustably and reversibly coupled or connected to each other.

As used herein, the term "reversibly" refers to an attachment that can be made such that the attachment is secure enough to safely and reliably hold the object to be concealed in its means for receiving, for example a handgun in its holster, in the desired position in its respective pocket, such that normal movement such as running, jumping, reaching, stretching, etc., will not dislodge the handgun and holster from the position selected by the user. However, the attachment of the object within its receiving means to a surface within its pocket, is still reversible in that the attachment can be disconnected, adjusted, and reconnected when desired by the user.

By way of example only, and without intending to limit the scope of the present invention, a means for attaching may comprise a first attachment means comprising a set of hook and loop structures, such as hook and loop material (e.g., Velcro™) strips, interconnected to an inside surface of a pocket. A second attachment means may comprise a second set of hook and loop material (e.g., Velcro™) strips interconnected to the means for receiving, for example a holster for holding a handgun, wherein the first and second attachment means are physically aligned opposite each other in a specific position selected by the user. The first and second attachment means are then brought into physical contact with each other and secured into place, for example, by pressing opposing hook and loop material strips against one another. Thus, embodiments of the present invention, allow a user to position and conceal a handgun within a pocket in a desired position, for example, such that the handgun is positioned in a pocket located on the right side of a garment, with a holster positioned such that the handle of the gun faces the right outside, vertical edge of the pocket, facilitating an easy and quick access and draw of the weapon from the pocket using the right hand. It would be known to one of ordinary skill in the art, that the use of a hook and loop material attachment means is releasable (i.e., not permanent), and that an advantage of such a system is the flexibility and adjustability of the receiving means, e.g., holster, within the pocket being used for concealment. It would also be known to one of ordinary skill in the art, that other attachment means are available to provide the same functionality as hook and loop material (e.g., Velcro™). Alternative solutions for attachment means within the scope of embodiments of the present invention include, but are not limited to, clasps, snaps, buttons, straps, magnets, loops, ties, and any other suitable system for reversibly mating/connecting two opposing parts.

In some embodiments of the present invention, an object concealment means integrated into at least one outer surface of a pocket may comprise a second outer layer fabric that covers a first inner layer fabric. By way of example, an object may be concealed by covering an outer surface of the pocket containing the object with a second layer of fabric or material that minimizes imprinting. Such a material may provide sufficient rigidity that imprinting is prevented. For example, a rigid outer material may comprise a plastic sheet positioned in an outer panel of the pocket, or positioned between two panels of fabric. Further examples of a rigid outer material for eliminating imprinting of the object or weapon being concealed may include the same types of materials used to construct moldable splints and immobilization devices, including moldable aluminum and plastics or combinations thereof. Alternatively, an outer layer object concealment means covering the pocket may comprise a laminated composite comprising a first and second layer with pliable, form-fitting material positioned between the two layers. Examples of such a pliable, form-fitting material include, but are not limited to, goose down, or any other suitable natural or synthetic fiber, such as wool and polyester. In still further embodiments of the present invention, an object concealment means may comprise an internal scaffold or rib system that is built into an outer panel of the pocket. Such a scaffold or rib system can be visualized as being similar to the flexible support rods of a collapsible tent; a series of substantially parallel support rods may be built into a pocket's outer panel such that the parallel rods prevent the shape of the concealed object from being perceptible through the outer panel.

In some embodiments of the present invention, the garment for concealing at least on object may comprise at least one means for supporting a weight associated with the at least on object being concealed, wherein the at least one means for supporting a weight may comprise at least one of a strap, a strip, a belt, a harness, a thong, a tie, a cable, a cord, a truss, any other suitable means for supporting a weight, and combinations thereof. The at least one means for supporting a weight, e.g., the weight of a handgun and/or its associated holster, may comprise a first end and a second end with a length of material spanning and connecting the two ends. A first end of the means for supporting a weight may be physically interconnected to at least one of the means for receiving (e.g., a holster) and the at least one means for attaching the means for receiving to an inner surface of the pocket. A first end of the means for supporting a weight may be reversibly interconnected. Mechanisms for attaching the first end of the means for supporting a weight to at least one of the means for receiving and the at least one means for attaching may include any of the standard methods known to one of ordinary skill in the art of clothing manufacture: e.g., hook and loop material, straps, buckles, buttons, clasps, snaps, and combinations thereof.

In some embodiments of the present invention, the second end of a means for supporting a weight may be interconnected to a weight supporting member. A weight supporting member may be a hook, loop, clip, button, a snap, a clasp, or the like interconnected to a point on the garment that is located above the pocket. For example, and without intending to limit the scope of the invention, weight supporting member can comprise a button located within a collar of the garment, such that a means for supporting a weight comprising a strap is positioned within the garment, such that the second end of the strap is interconnected to the button. The length of the strap may pass over the shoulder of the garment and descend down to the pocket concealing the object, wherein the first end of the strap (the means for supporting the weight) is interconnected to at least one of the receiving means (e.g., holster) and the at least one attachment means. In still further embodiments of the present invention, a means for supporting a weight, may comprise a strap or equivalent structure, wherein the length of the strap is adjustable. As would be known to one of ordinary skill in the art of garment manufacture, such an adjustable length may be achieved by the use of a buckle or some other suitable mechanism. As used herein, a "harness" is one "means for supporting."

In still further embodiments of the present invention, a weight supporting member may comprise a piece of fabric or material sewn into a portion of the garment located above the position of the pocket being used to conceal the object, for example in the collar of a garment.

A further aspect of the present invention is a garment for concealing at least two objects, wherein the garment comprises a left front panel and a right front panel, wherein the left and right panels comprise top and bottom ends, and are separated or connected by a vertically oriented connecting means, and the garment further comprises a collar interconnected to the top ends of the left and right front panels. Further, each front panel comprises a pocket, wherein each pocket comprises a means for accessing an internal volume of the pocket, at least one means for receiving the at least one object when placed in each pocket, a means for attaching the at least one means for receiving to at least one inside surface of each pocket, and an object concealment means integrated into at least one outer surface of each pocket. Further, the pocket of the right panel comprises a first means for supporting a weight, further comprising a first end and a second end with a length spanning therebetween, and the pocket of the left panel comprises a second means for supporting a weight, also comprising a first end and a second end with a length spanning therebetween. Further, the second end of the first means for supporting a weight and the second end of the second means for supporting a weight both attach to a weight supporting member anchored on a posterior side of the garment in the collar. Finally, the first end of the first means for supporting a weight attaches to at least one of the means for receiving and the means for attaching of the right pocket, and the first end of the second means for supporting a weight attaches to at least one of the means for receiving and the means for attaching of the left pocket.

In some embodiments of the present invention, a garment for concealing an object, e.g., a handgun, may comprise a jacket, parka or coat, wherein the garment comprises at least two front panels made of a suitable material, such as a fabric. The at least two front panels may separated from each other done a central, longitudinal axis by a vertically oriented connecting means. In some embodiments of the present invention, the vertical connecting means may comprise a zipper, buttons, or some other suitable connecting means. Further, the garment may comprise at least one pocket mounted in each front panel, wherein each pocket is designed and constructed to conceal an object, substantially as described above. A two-pocket garment design offers the following additional benefits.

In some embodiments of the present invention, a garment comprising two-pockets configured to conceal an object comprises two symmetrical front panels, each with one pocket for concealment. Further, such a garment may comprise a single weight supporting member mounted at a point centrally located between the two symmetrical front panels and vertically above both of the two pockets, for example at a collar. In addition, each pocket may further comprise its own means for receiving, means for attaching, and means for supporting, substantially as described above. Each means for supporting may comprise a second end, both of which terminate and attach to the single weight supporting member. Such a configuration has the advantage in that the opposing, symmetrically located pockets can act as counterweights relative to one another.

A further aspect of the present invention is a garment for concealing at least one handgun, comprising at least one pocket, wherein each pocket comprises a means for accessing an internal volume of the pocket, at least one holster for receiving the at least one handgun when placed in the pocket, a means for attaching the at least one holster to at least one inside surface of the pocket, and a handgun concealment means integrated into at least one outer surface of the pocket. Further, the garment comprises at least one harness for supporting a weight associated with the at least handgun, wherein the harness comprises a first end, a second end, and a strap spanning between the first end and the second end, wherein the first end is interconnected to at least one of the at least one holster and the means for attaching, and the second end is interconnected to a weight supporting member.

In some embodiments of the present invention, the garment for concealing at least one handgun comprises a holster with a trigger guard.

The invention now being generally described will be more readily understood by reference to the following examples, which are included merely for the purposes of illustration of certain aspects of the embodiments of the present invention. The examples are not intended to limit the invention, as one of skill in the art would recognize from the above teachings and the following examples that other techniques and methods can satisfy the claims and can be employed without departing from the scope of the claimed invention.

Referring now to FIG. 1, a garment 102 for concealing in item 104 (a handgun) is shown, comprising a pocket 106 comprising four edges and positioned in a lower front left panel of the garment. A means for accessing 108 the contents of pocket is located on an outside left vertical edge of the pocket 106. Such a means for accessing could be, for example, a zipper, or alternatively, could simply be an opening without any means for closing the pocket.

Figure 2A:
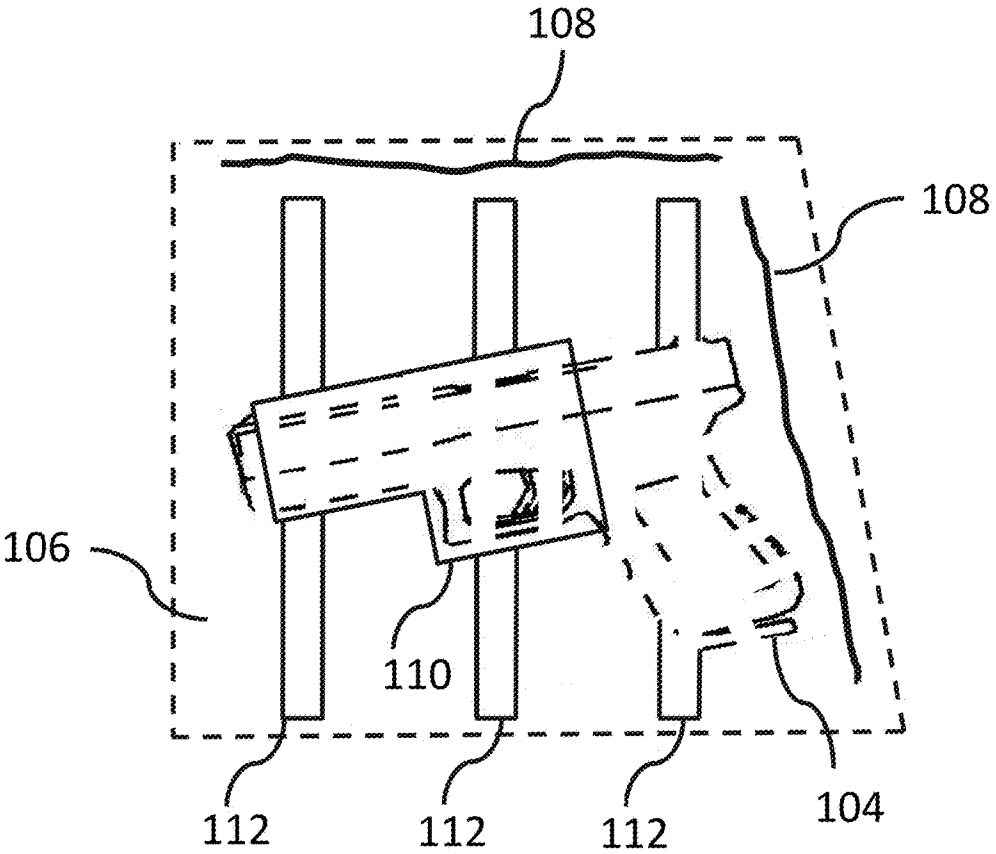
FIG. 2A illustrates an embodiment of a pocket of an outer garment for concealing a handgun in a first position wherein the handle of the handgun is facing the wearer's left side or hand. This figure also highlights the support means that holds the handgun, e.g., a holster, and the means for attaching the holster to an inside surface of the pocket.
Figure 2B:
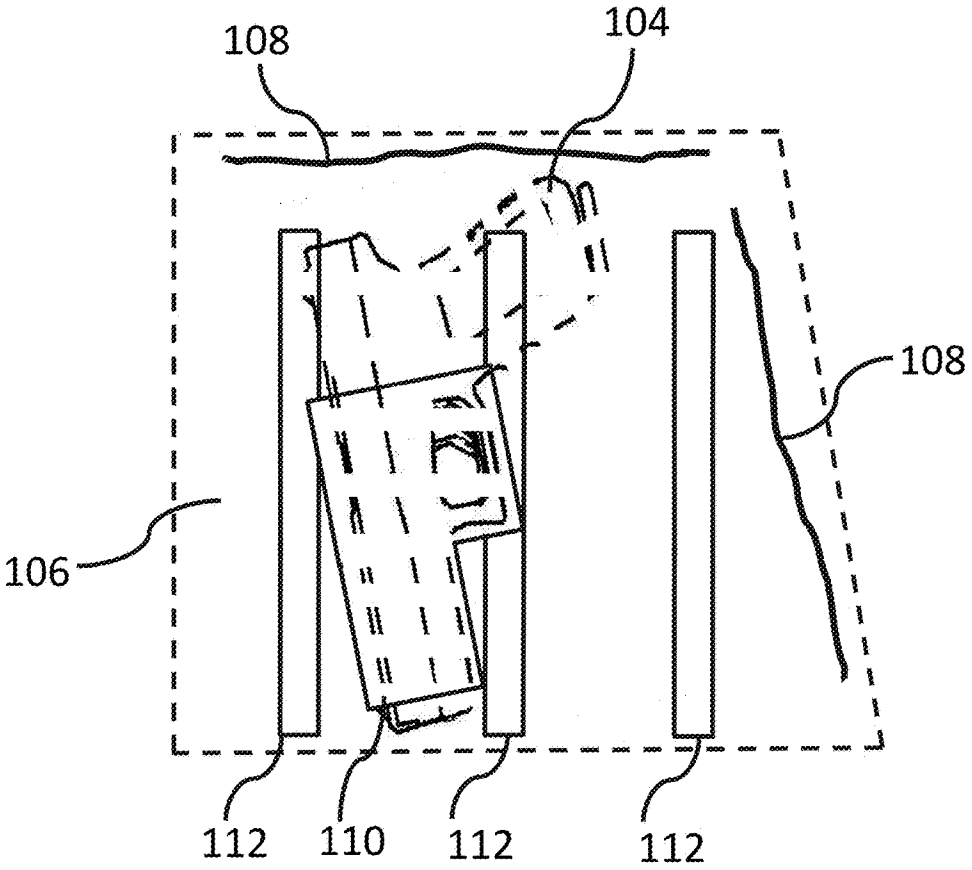
FIG. 2B illustrates a further embodiment of a pocket of an outer garment for concealing a handgun that has been rotated to a second position wherein the handle of the handgun is facing up.

Referring now to FIG. 2A, a pocket 106 with a means for accessing 108 the contents of the pocket is shown. A concealed item 104 (a handgun) is shown inserted and stored in a receiving means 110 (holster). Three vertically oriented attachment means 112 are shown which enable the receiving means to interface or connect with an inside surface of the pocket, in a specific, desired orientation specified by the user. For example, and without intending to limit the scope of the present invention, the three vertically oriented attachment means 112 may comprise three vertically oriented hook and loop material strips that are sewn to the inside panel of the pocket. The attachment means may further comprise hook and loop material (e.g., Velcro™) mounted on an opposing face of the receiving means 110, such that the strips and opposing face are in contact and maintain the receiving means 110 in the desired position selected by the user. As shown in FIG. 2A, in this example, a handgun is mounted with the handle of the handgun oriented towards the means for access 108 for a preferred draw from the left side of the pocket. Referring now to FIG. 2B, the same pocket is illustrated, however in this case, the user has intentionally rotated the position of the receiving means 108, e.g., the holster, and the concealed item, e.g., a handgun, to a second vertical position to allow access from a second pocket 108. It will be obvious to one of ordinary skill in the art, that such a pocket design enables a wide range of orientations of a concealed handgun, such that any preferred orientation can be matched with a firearm and a method of drawing the firearm.

Figure 3:
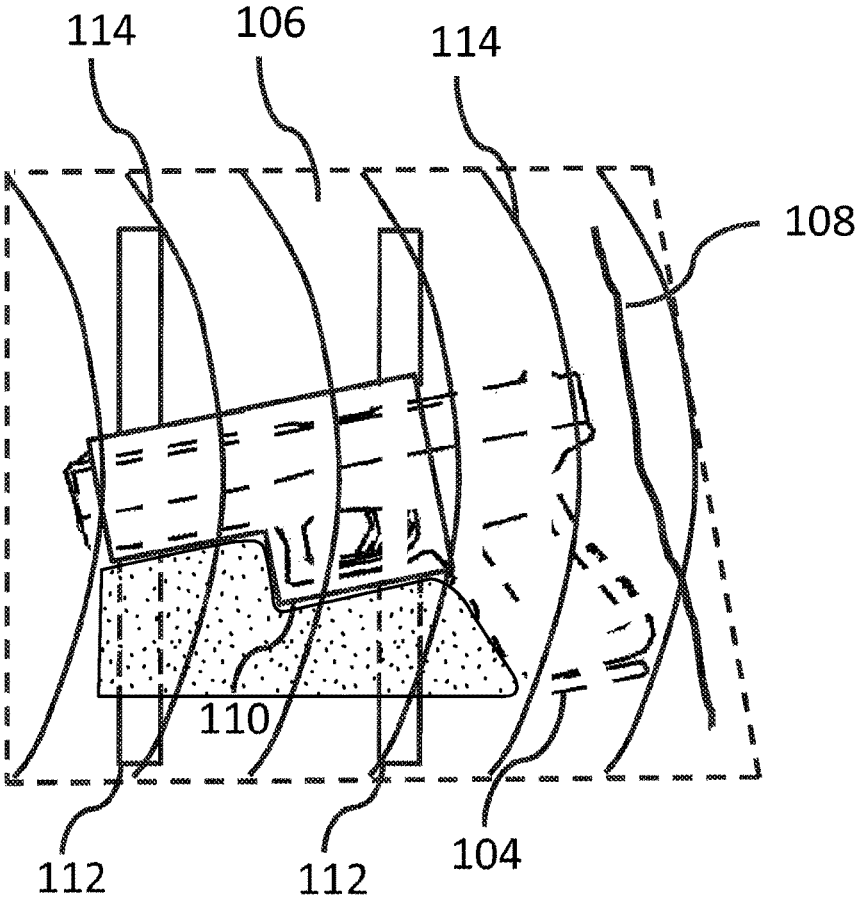
FIG. 3 illustrates an embodiment of a pocket of an outer garment with a holster and support means, and a pocket structure for concealing the outline of the weapon.

Referring now to FIG. 3, a pocket 106 for concealing an item 104 is illustrated with a rib system as an object concealment means 112. In this example, the rib system comprises several arcuate ribs arranged in a substantially parallel and vertical position. The ribs prevent the profile or outline of the concealed item 104 from showing through the front panel of the pocket 106, when the concealed item is pressed against the front panel. The scope of the present invention is not limited to an object concealment means comprising a rib system, and other embodiments are described above.

Figure 4:
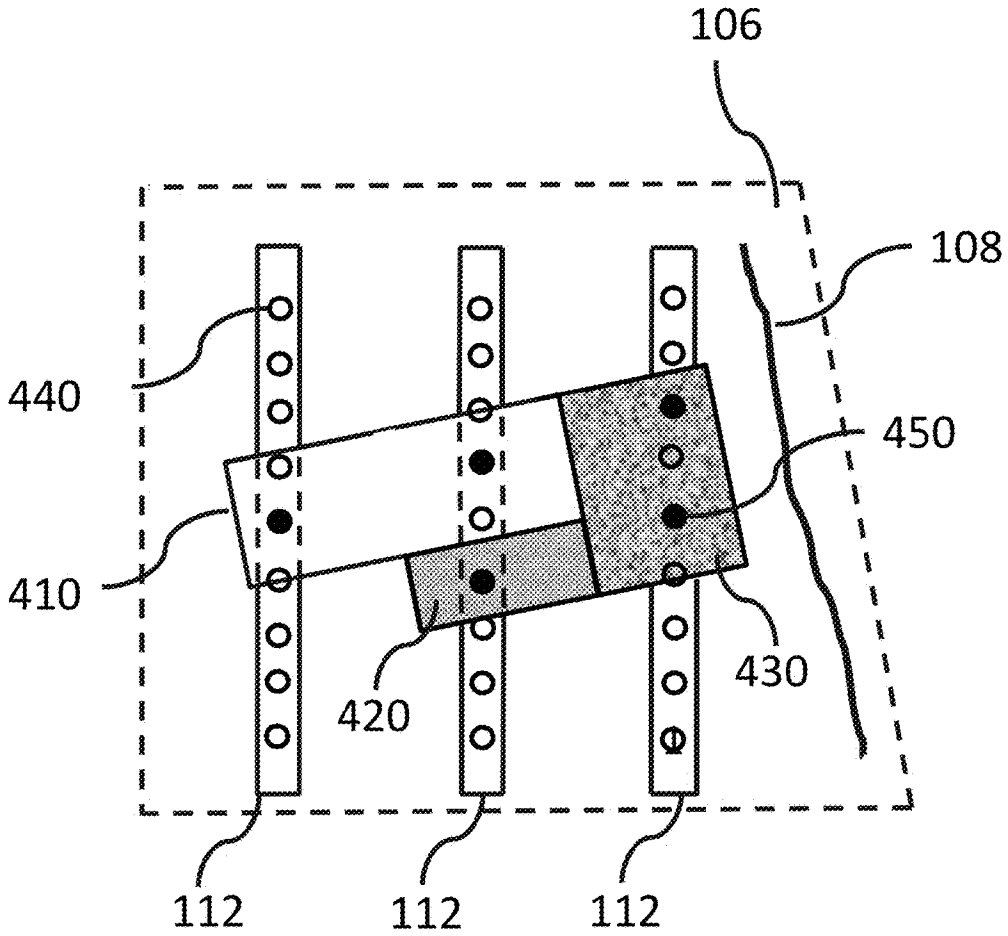
FIG. 4 illustrates yet another embodiment of a pocket for concealing a weapon in a garment, with a connecting system for adjusting and supporting a holster in a desired position within the pocket.

FIG. 4 illustrates another embodiment of the present invention for securing a holster 410 to an inside surface of a pocket 106 for concealing a handgun. In this embodiment, the attachment means 112 consists of three strips of material or fabric that are interconnected to the inside panel of the pocket 106. Each strip of the attachment means 112 further comprises several buttons, snaps, or other suitable connectors. The handgun holster 410 comprises an opposing surface that faces the inside panel of the pocket and the attachment means 112. This surface of the holster has corresponding and matching buttons, snaps, or other suitable connectors that mate and attach to the corresponding and matching buttons, snaps, or connectors positioned on the attachment means 112. Referring again to FIG. 4, matching sets of connectors that are in use are represented by solid circles 450. These connectors reversible lock the holster 410 in place and attach it to the inner panel of the pocket, in the position desired by the user. Each attachment means 112 provides a series of multiple buttons, snaps, or connectors to provide the user with many different positions and holster alignment choices. The connectors not in use 450, are illustrated by empty circles. These connectors provide the user with the different alternative holster positions and alignments.

FIG. 4 also illustrates a holster with a trigger guard 420, and a tab 430, wherein the tab provides extra surface area on the holster to provide better securement of the holster 410 to the attachment means 112.

Figure 5:
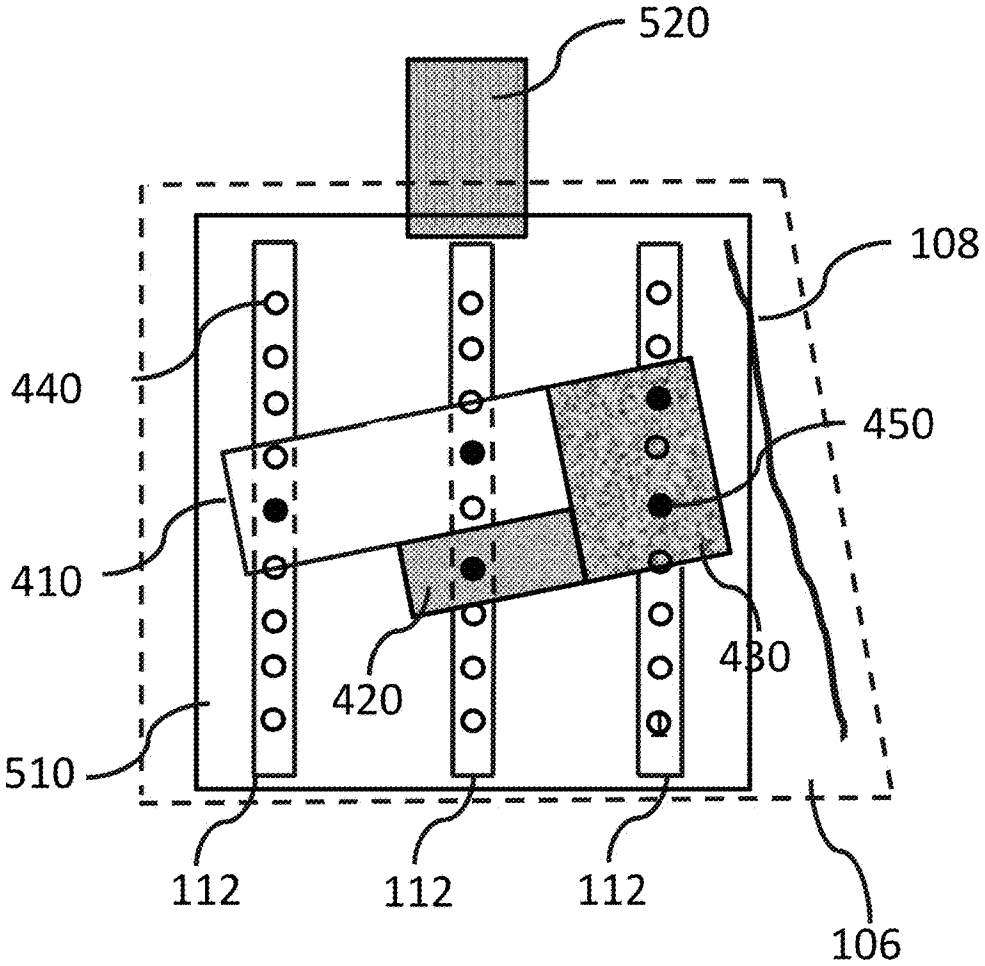
FIG. 5 illustrates an embodiment of a pocket for concealing a weapon in a garment, with a further means for attaching and supporting the weapon within the garment.

Referring now to FIG. 5, the embodiment of the present invention shown in FIG. 4 is shown again, but now with the additional features of an attachment panel 510 and a support means 520. In this embodiment of the present invention, instead of attaching the attachment means 112 to the inside panel of the pocket, the attachment means are interconnected to an optional support structure, an attachment panel 510, which is then secured to the inside panel of the pocket 106. In some embodiments of the present invention, the attachment panel may comprise a somewhat rigid material that provides additional structural support to the attachment means. Such a support may comprise a plastic or a reinforced fabric. FIG. 5 also shows a support means 520 physically interconnected to an upper edge of the attachment panel 510. The support means 520 supports the weight of the handgun and the holster so that they do not settle in the pocket, which would result in a higher probability of the outline of the handgun showing up through the fabric, allowing an observer to identify the handgun. It will be obvious to one of ordinary skill in the art that the support means 520 may comprise a harness system that comprises multiple straps that attach to an upper portion of an attachment panel 510.

Figure 6:
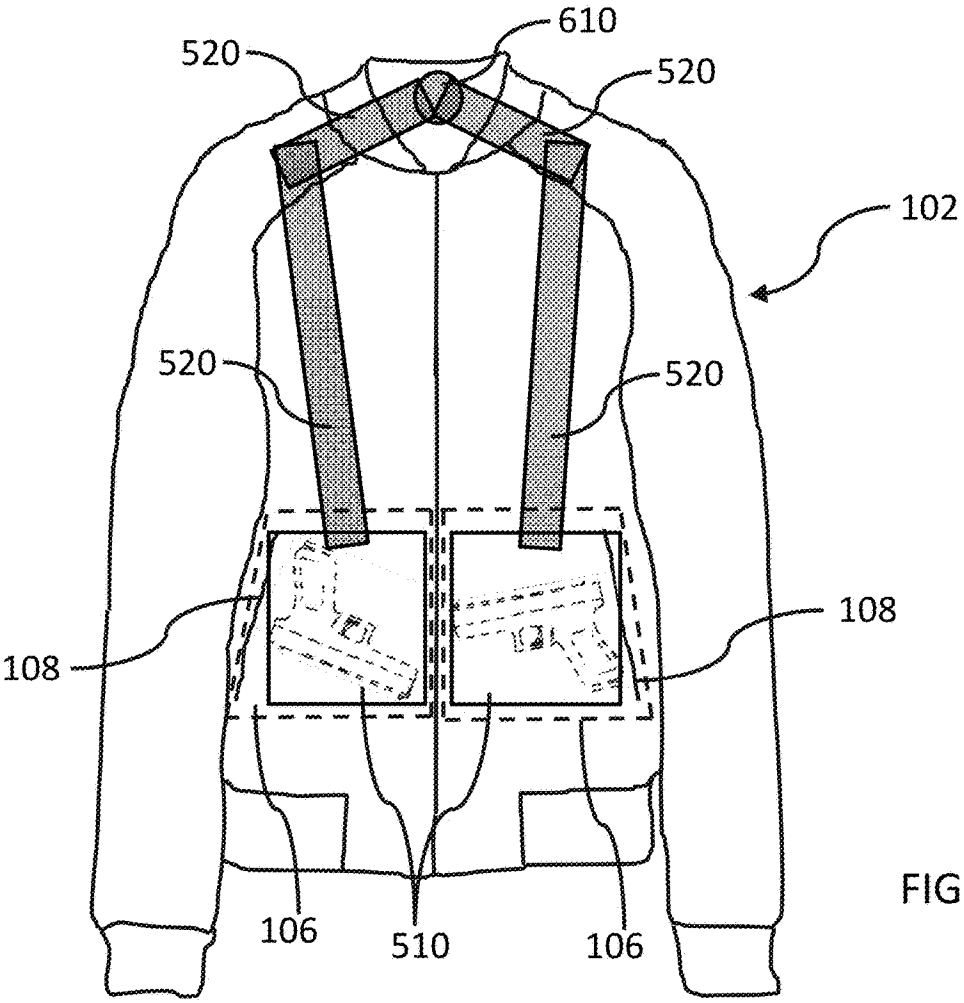
FIG. 6 illustrates an embodiment of a garment with two pockets for concealing at least two objects, and a means for supporting the at least two concealed objects using an adjustable harness-like system that is secured at a weight support point located at the back of the neck.

FIG. 6 illustrates a completely contained garment system for concealing two handguns in two independent and distinct pockets, wherein the pockets are positioned in opposing symmetrical front panels of the garment. Both pockets 106 comprise the features described above, a means for access 108, a holster (not shown), attachment means (not shown), object concealment means (not shown), etc. FIG. 6 specifically illustrates the relationship of each pocket's attachment panel 510 and support means 520 to a centrally located weight supporting member 610, located behind the wearer's neck in the collar. In this embodiment of the present invention, each pocket is provided with a strap-like support means 520 that is interconnected to an upper edge of its corresponding attachment panel 510, wherein each attachment panel 510 is located in its corresponding pocket and physically interconnected (e.g., stitched or sewn) to an inside surface of the pocket's inner panel. The first end of each strap-like support means 520 is physically interconnected to the attachment panel 510. The length of each support means 520 then ascends substantially vertically towards its respective shoulder of the garment 102, at which point each strap turns towards the collar of the garment where it attaches to the weight supporting member 610. In some embodiments of the present invention, the support means 520 are incorporated directly into the fabric structure that constructs the garment. In some cases, the turning points of the support means at the shoulders may be facilitated by loops and/or rings (not shown) interconnected at the shoulders, within the garment.

Figure 7:
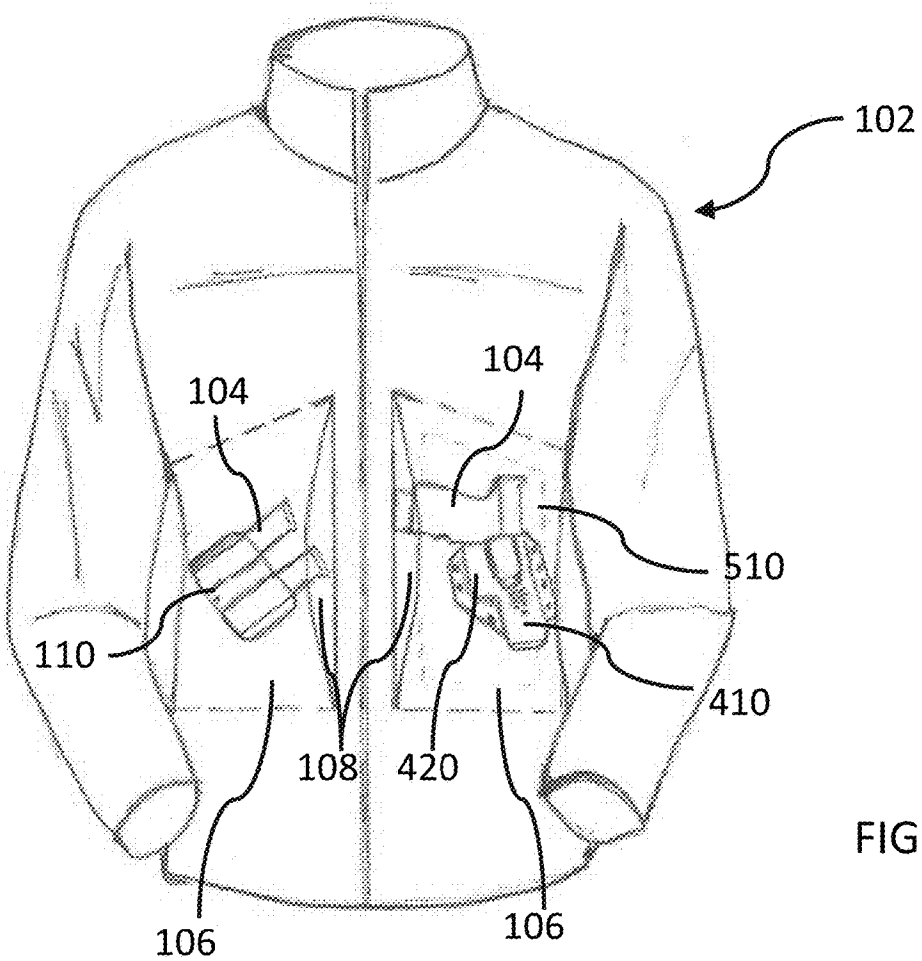
FIG. 7 illustrates another embodiment of an outer upper garment with two opposing pockets for concealing at least two objects, including a handgun and ammunition.
Figure 8:
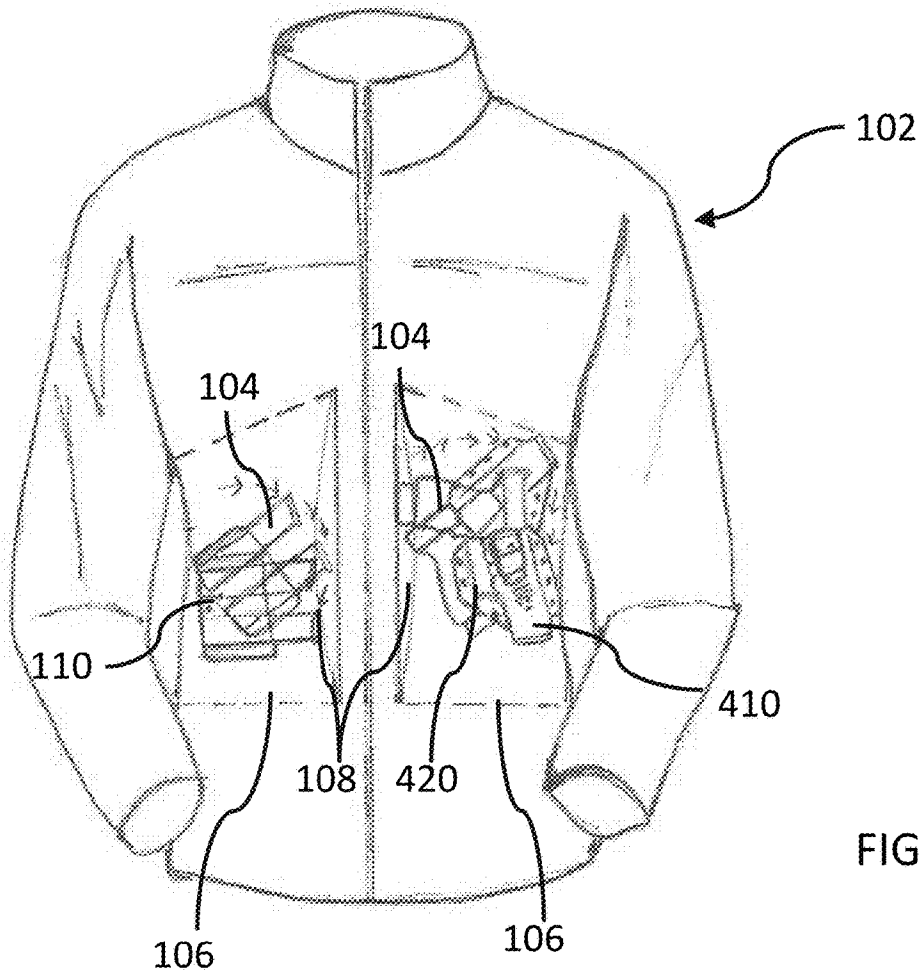
FIG. 8 illustrates another embodiment of a variation of FIG. 7, wherein two support means (e.g., a holster for a gun) have been rotated from a first position to a second position.

FIGS. 7 and 8 illustrate another embodiment of a garment for concealing a handgun and its associated ammunition, wherein a receiving means 110 and a holster 410 comprising a trigger guard 420, carrying items to be concealed 104, can be rotated from first positions shown in FIG. 7 to second positions shown in FIG. 8.

Figure 9:
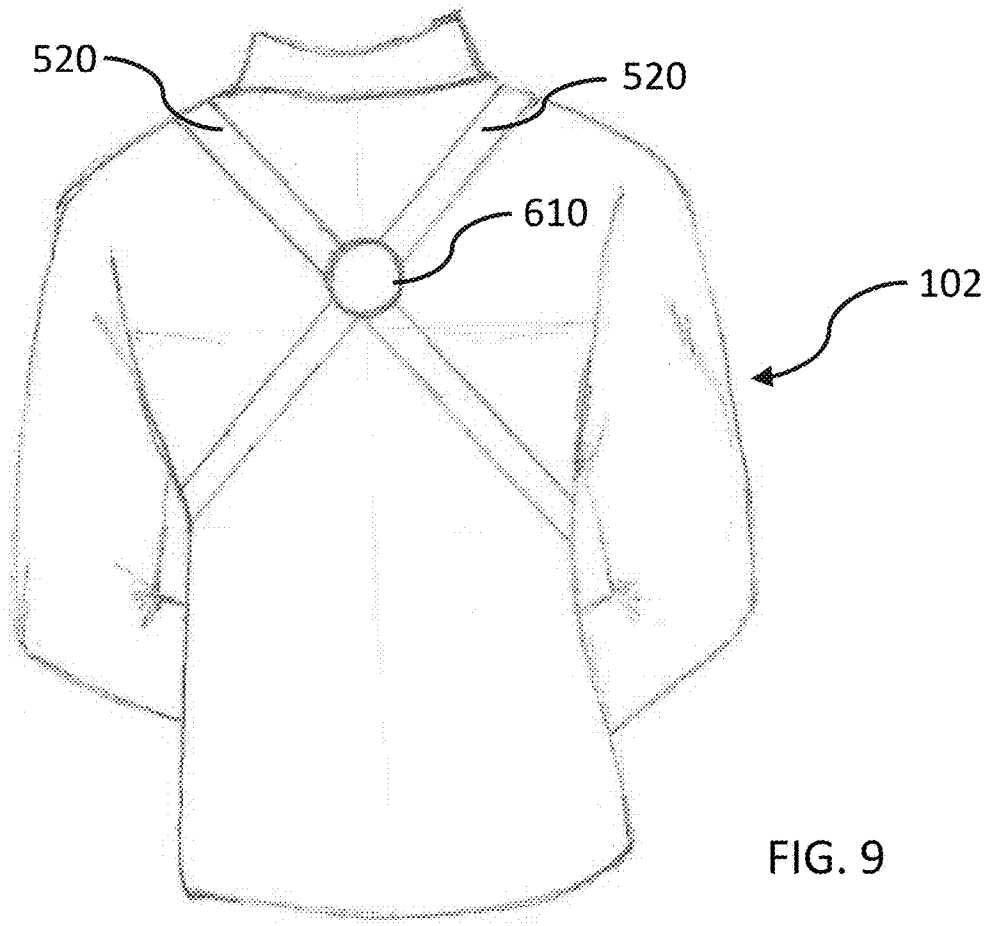
FIG. 9 illustrates yet another embodiment of an integrated internal support system for distributing and carrying the weight of the concealed objects.

Finally, FIG. 9 illustrates an alternative support means 520 and weight supporting member 610 comprising a harness system with straps that go over the shoulders and terminate at a weight supporting member that is below the collar of the garment.

Figure 10:
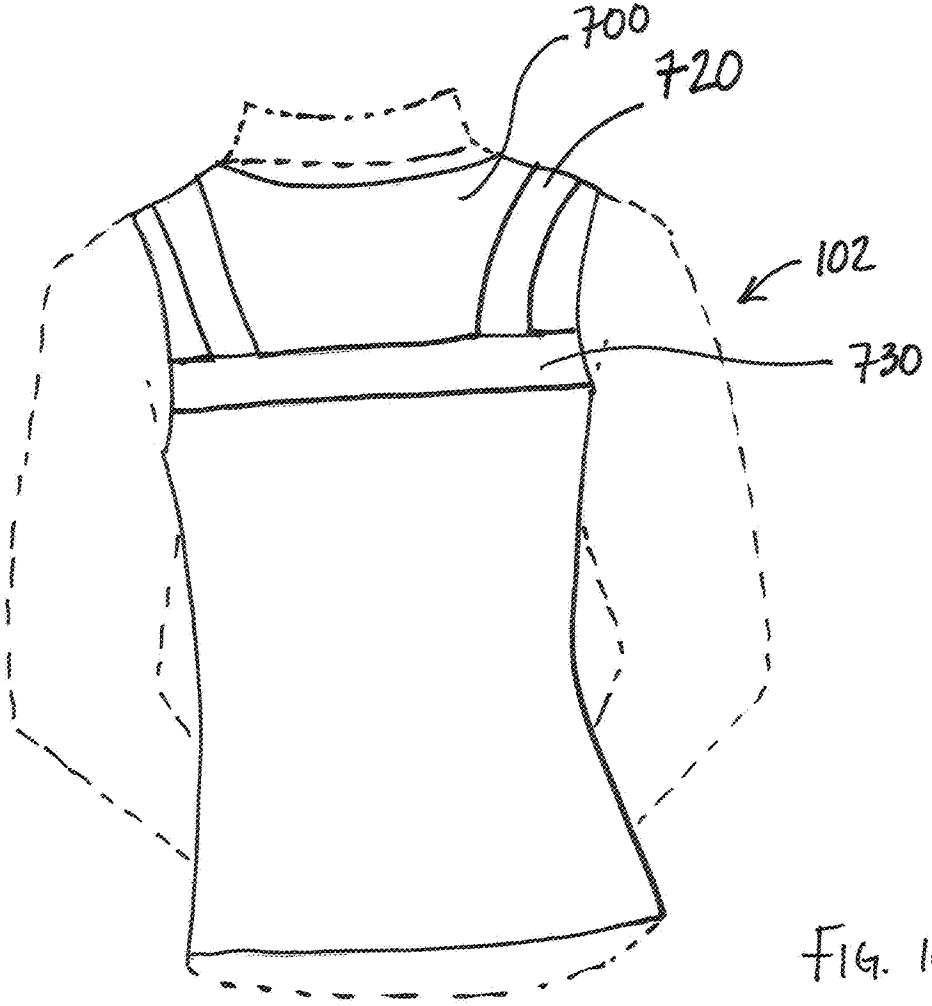
FIG. 10 shows a rear view of one embodiment of a garment with a vest for carrying concealed objects.

FIG. 10 shows a rear view of one embodiment of the garment 102 in dotted lines. In this embodiment, the garment 102 comprises an internal vest 700. The vest 700 can be secured (either permanently or detachably) in the garment 102. In order to see the vest 700, the garment 102 is shown in phantom lines. In one embodiment, the vest 700 comprises support straps 720 that extend from the pocket (not shown because on the front of the vest 700), over the shoulder area, and to a middle section of the back of the vest 700. In some embodiments, the support straps 720 either include or are interconnected to a substantially horizontal support strap 730. The straps 720, 740 improve the comfort of the garment 102. The straps 720, 740 can be positioned on an inner surface of the vest 700, an outer surface of the vest 700, or between the inner and outer surface of the vest 700.

Figure 11:
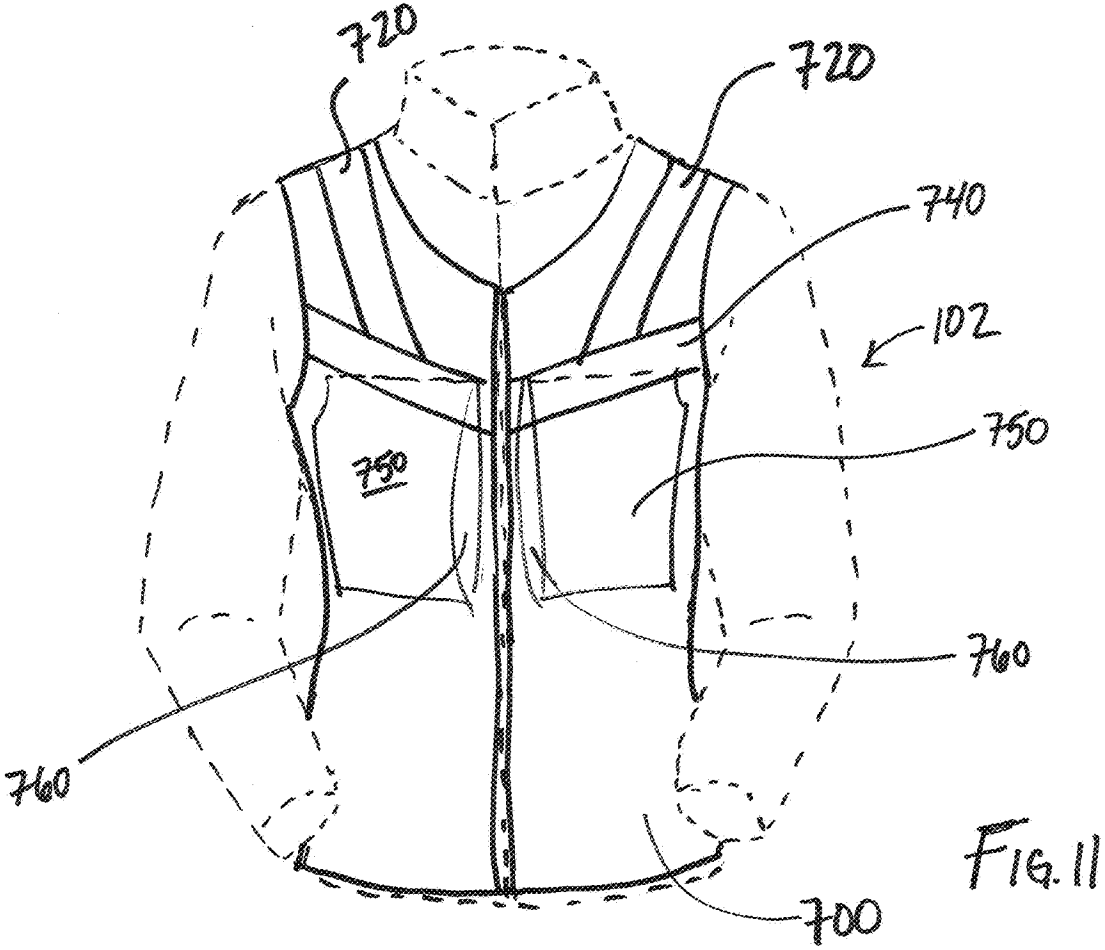
FIG. 11 shows a front view of one embodiment of a garment with a vest for carrying concealed objects.

FIG. 11 shows a front view of one embodiment of the garment 102 in dotted lines. In this embodiment, the garment 102 comprises an internal vest 700. The vest 700 can be secured (either permanently or detachably) in the garment 102. In order to see the vest 700, the garment 102 is shown in phantom lines. In one embodiment, the vest 700 comprises support straps 720 that extend from the pockets 750 and over the shoulder area to the back of the vest 700. The support straps either include or are interconnected to angled support straps 740 that interconnect to the pockets 750 and extend toward the arm pit area of the vest 700. Alternatively, the support straps 720 can extend all the way down to the pockets 750 and not include angled support straps 740. The support straps 720 and angled support straps 740 support the weight of a weapon or other object placed in the pockets 750. The support straps 720 and angled support straps 740 distribute the weight of the object in the pocket 750 such that the pocket or area of the garment 102 with the pocket 750 is not pulled downward. The straps 720, 740 improve the comfort of the garment 102. The straps 720, 740 can be positioned on an inner surface of the vest 700, an outer surface of the vest 700, or between the inner and outer surface of the vest 700. In some embodiments, the vest is made of a mesh-like material that stretches is a horizontal direction but stretches very little in the vertical direction, prevents the weight of the object stored in the pockets 750 from pulling the vest 700 and/or garment 102 downward. The limited stretching in the vertical direction also assists in the weight distribution of the object in the pocket 750 across more of the vest 700 and garment 102. Additionally, the vest 700 may be thick enough that foam and/or a rigid sheet is not needed in the garment 102, vest 700, or pocket 750 to hide the outline of the item stored in the pocket 750. Thus, the thickness of the vest 700 and/or pocket 750 alone may be enough to conceal the identity of the object in the pocket 750.

Each pocket 750 includes an opening 760 to permit access to the pocket 750 and access to the objects stored in the pocket 750. The pockets 750 may have closure mechanisms located at the openings 760 (not shown) to limit access to object in the pockets 750. In one embodiment, the pocket 750 comprises an inner surface defining an internal volume. The inner surface may be a soft material, such as fleece or other material, to which the hook material (of hook and loop material, like Velcro) can be secured. Thus, the holster may have one or more strips of hook material on an outer surface of the holster or holder to allow a user to secure the holster or holder to any portion of the inner surface of the pocket. This will allow a user to position the holster or holder to the position of the pocket that the user desires. Therefore, the object will be positioned in a position most comfortable for the user. Further, the user can move the holster or holder within the pocket depending on the object the user is carrying. For example, the holster may be positioned in one location for a large handgun and the holster may be positioned in a different location for a smaller handgun. The garment 102 will have access points in the outer surface of the garment allowing the user access to the internal pockets 750. The garment's access points may be secured or closed using a zipper, buttons, hooks, snaps, hook and loop material, or any other pocket or garment securing means known in the art.

It should be apparent that although some embodiments of the present invention incorporate an attachment means for positioning a holster within a specific location, that such an attachment is not necessarily required. Alternatively, a holster may simply hang within the pocket, such that a support means, for example a strap or a harness interconnected to a holster provide the only securement means within the pocket.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention. Those skilled in the art will appreciate that the conception upon which this disclosure is based, may readily be utilized as a basis for designing of other structures, methods and systems for carrying out the several purposes of the present invention to create a garment comprising at least one pocket configured to carry, in a concealed and readily-accessible state, a handgun. It is important, therefore, that the claims be regarded as including any such equivalent construction insofar as they do not depart from the spirit and scope of the present invention.

What is claimed is:

1. A garment for concealing a handgun, comprising:

an upper torso garment having an inner fabric portion and an outer fabric portion, with a cavity provided in an interior pocket, said interior pocket having padding to support a stowed handgun and to provide cushioning such that the outer fabric portion of the upper garment is not placed under stress in a manner that would reveal that a handgun is residing within said garment, said cavity in the interior pocket having a top padding with a thickness, consistency and density that is different from a lower portion padding, said lower portion padding positioned below a handgun when a handgun is stored in the interior pocket, the lower portion padding comprised of a more dense material than said top padding so as to be better able support the gravitational weight of the handgun, said interior pocket adapted to receive, restrain and to provide for fully concealing a quick-draw access to a handgun, said interior pocket comprising: an outer surface; an inner surface; an internal volume defined by the inner surface; and an opening providing access to the internal volume; and wherein at least the top padding comprises a memory foam having a perpendicular dimension that extends beyond an edge of the handgun to conceal the outline of the handgun when the handgun is placed inside the interior pocket of the garment.

2. The garment as set forth in claim 1, wherein the garment has a collar and a waist region; and said interior pocket has a structural longitudinally extending member having a bowed characteristic extending from a first attachment point on the upper portion of said interior pocket, and a second attachment point at the waist region, said bowed longitudinally extending member maintaining a cave-like cavity within the opening, thereby providing access to the internal volume when a handgun is positioned in said pocket.

3. The garment as set forth in claim 2, wherein the internal portion of the pocket defined by the outer configuration of the handgun to be placed therein, with at least a supporting memory foam component on a lower-most region of internal pocket to support a handgun, the memory foam having a perpendicular dimension that extends beyond an edge of a handgun to conceal the outline of a handgun when placed inside the interior pocket of the garment.

* * * * *